United States Patent [19]

Henriksson

[11] Patent Number: 4,650,246

[45] Date of Patent: Mar. 17, 1987

[54] BABY CHAIR

[75] Inventor: Kjell Henriksson, Bredaryd, Sweden

[73] Assignee: Baby Bjorn Aktiebolag, Bredaryd, Sweden

[21] Appl. No.: 796,397

[22] Filed: Nov. 8, 1985

[30] Foreign Application Priority Data

Nov. 12, 1984 [SE] Sweden ..... 8405661

[51] Int. Cl.[4] ..... A47D 1/10

[52] U.S. Cl. ..... 297/250; 297/467; 297/487

[58] Field of Search ..... 297/250, 467, 487, 488, 297/174

[56] References Cited

U.S. PATENT DOCUMENTS

| | | | |
|---|---|---|---|
| 1,967,533 | 7/1934 | Koop | 297/250 |
| 2,418,731 | 4/1947 | Seitz | 297/250 |
| 2,489,087 | 11/1949 | Hewit, Jr. | 297/250 |
| 2,633,900 | 4/1953 | Davis | 297/174 |
| 3,065,028 | 11/1962 | Irion | 297/467 |
| 3,335,434 | 8/1967 | Gamon | 297/250 |
| 3,563,600 | 2/1971 | Converse | 297/467 |
| 3,788,699 | 1/1974 | Starr | 297/488 |
| 3,934,934 | 1/1976 | Farrell, Jr. et al. | 297/467 |
| 4,521,052 | 6/1985 | Cone | 297/250 |

FOREIGN PATENT DOCUMENTS 2342687 9/1977 France .

*Primary Examiner*—Francis K. Zugel

*Attorney, Agent, or Firm*—Fleit, Jacobson, Cohn & Price

[57] ABSTRACT

A chair for babies or young infants is intended to be placed on the seat of a conventional chair and comprises a base of substantially square horizontal cross-section, defined at the top thereof by a seat surface. Side and back support parts are formed integrally with the base and the seat surface and extend upwardly from a respective one of three base sides and three edges of the seat surface. The upper edges of the side support parts have gently rounded cross-section, and means are provided for securing the infant's chair to the seat of a conventional chair. The infant's chair is provided with a detachable front and crutch support, which includes a cross-piece, which extends substantially parallel with the front edge of the seat surface, and an upstanding crutch-piece, which extends between the central regions of the cross-piece and the aforementioned front edge. The upper edges of the side support parts extend substantially horizontally from the front of the infant's chair over a major part of their length at a height above the seat surface corresponding to about 0.2–0.75 times the height of the upper edge of the cross-piece above the seat surface. The side support parts are extended upwardly to approximately the level of the upper edge of the cross-piece by means of extension pieces formed integrally with the cross-piece and extending rearwardly from the ends thereof.

11 Claims, 7 Drawing Figures

Fig. 1
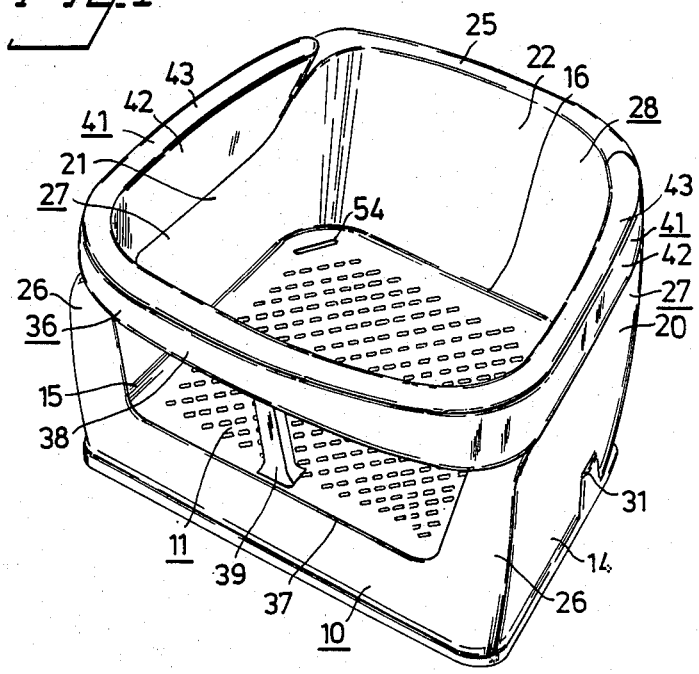
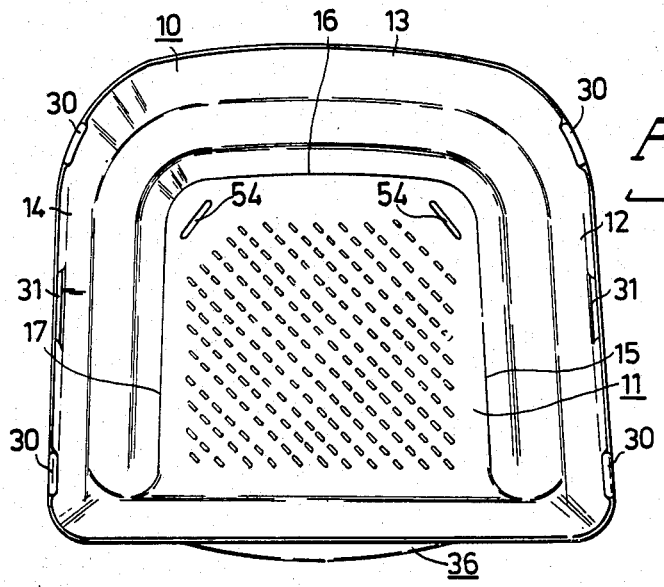
Fig. 2

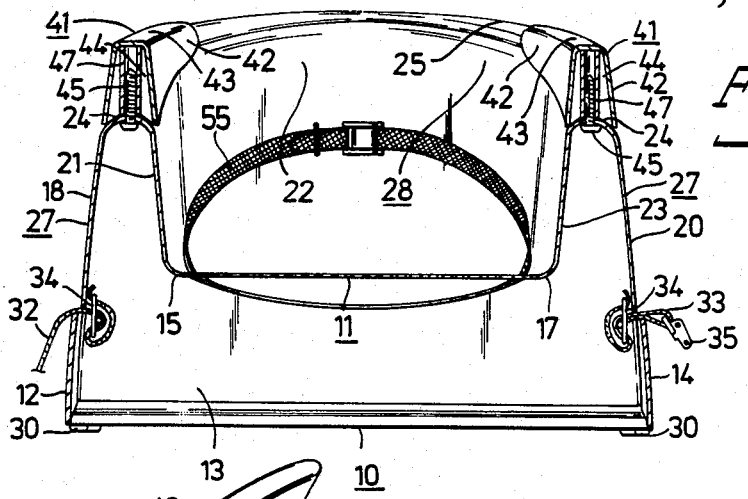
Fig. 3
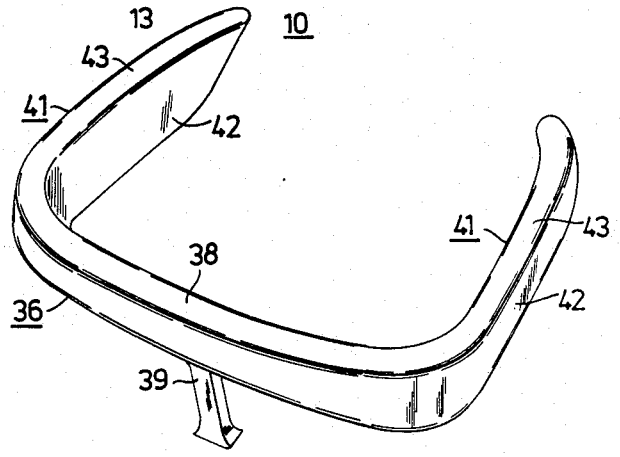
Fig. 4
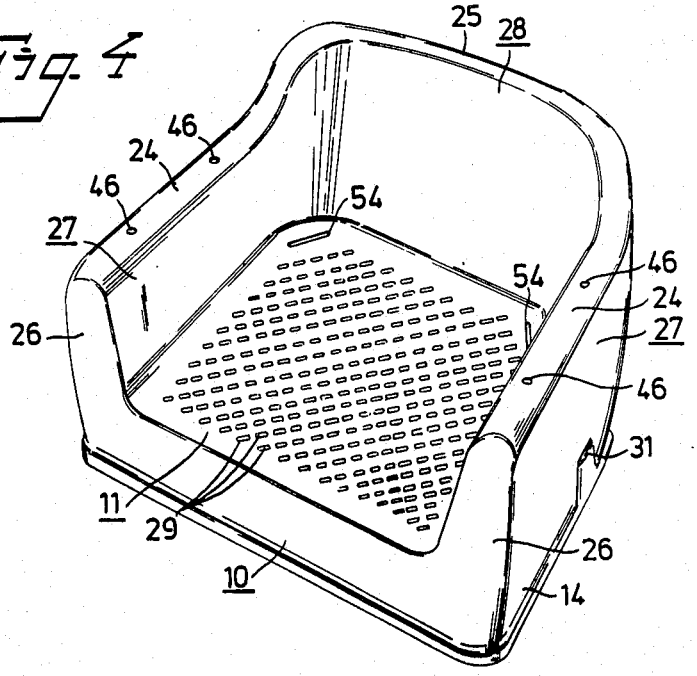

Fig. 5
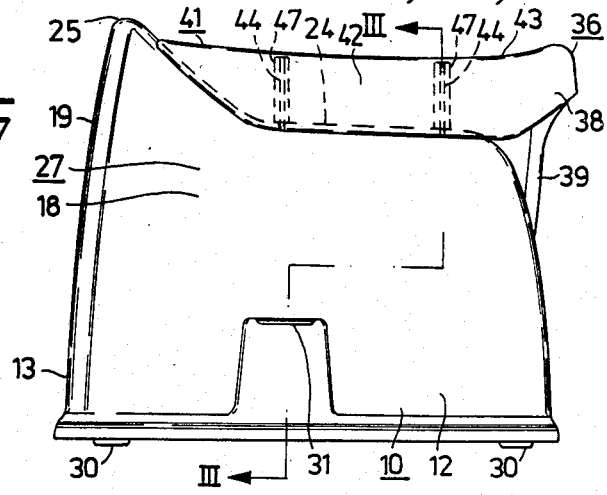
Fig. 6
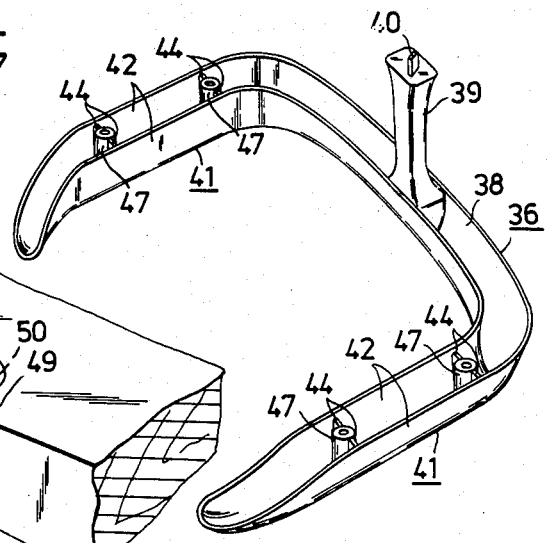
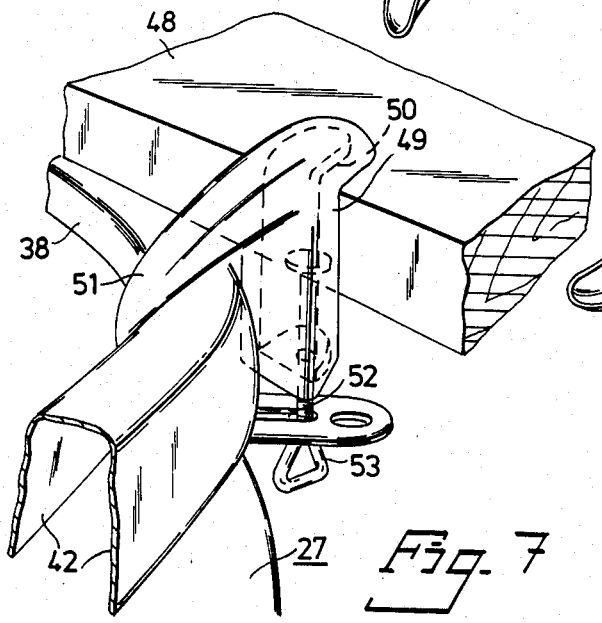
Fig. 7

BABY CHAIR

The present invention relates to a baby chair or infant's chair adapted to be placed on the seat of a conventional chair.

An infant's chair of this kind is known from, for example, French Pat. Specification No. 7706366.

An object of the invention is to provide a novel and improved infant's chair capable of being used, in a known manner, in combination with a conventional chair to provide a so-called highchair, with which, for example, a child can be seated at the correct height in relation to a dining table. At the same time, the infant's chair shall be comfortable for both very young children which need to be prevented from toppling and falling when seated, e.g. children from the age of 6 months to two years, and for older children such as children of from two years to five years of age.

To this end there is provided in accordance with the invention an infant's chair adapted to be placed on the seat of a conventional chair, comprising a base, which is of substantially square horizontal cross-section and which in defined at the top thereof by an upper seat surface;

side and back support parts formed integrally with the base and the seat surface and extending upwardly from a respective one of three base sides and three edges of the seat surface, the upper edges of the side support parts having gently rounded cross-section;

means for securing the infant's chair to the seat of a conventional chair; and a detachable front and crutch support, comprising a cross-piece, which extends substantially parallel with the front edge of the seat surface, and an upstanding crutch-piece which extends between central regions of the cross-piece and said front edge, wherein the upper edges of said side support parts extend substantially horizontally from the front of the infant's chair over at least a major part of their length at a height above the seat surface corresponding to about 0.2 to 0.75 times the height of the upper edge of the cross-piece above the seat surface, and wherein the side support parts are extended upwardly to a height corresponding approximately to the level of the upper edge of the cross-piece with the aid of extension pieces formed integrally with the cross-piece and extending rearwardly from the ends thereof.

An infant's chair constructed in accordance with the invention will afford adequate lateral support against a young infant or baby toppling sideways when the front and crutch support is fitted and is sufficiently roomy when the front and crutch support is detached to afford freedom of movement and comfort to older infants who no longer need such lateral support.

Additional characteristic features of the invention and advantages afforded thereby will be apparent from the following description of an exemplifying embodiment of the invention, made with reference to the accompanying drawings.

FIG. 1 is a perspective view of an infant's chair constructed in accordance with the invention;

FIG. 2 is a view taken from underneath the infant's chair;

FIG. 3 is a sectional view taken on the line III—III in FIG. 5;

FIG. 4 is an exploded view of the infant's chair;

FIG. 5 is a side view of the infant's chair;

FIG. 6 is a perspective view illustrating the front and crutch support obliquely from beneath; and FIG. 7 is a perspective detail view illustrating means for securing the infant's chair to a table top.

The infant's chair illustrated in the drawings comprises a base 10, which is of substantially rectangular horizontal cross-section and which is defined at the top thereof by a substantially horizontal seat surface (11). Wall panels 18–23 extend upwardly from a respective one of three base sides 12–14 and three seat surface edges 15–17, which wall panels meet at their respective upper ends and at the forward side of the chair in gently rounded edges 24–26, to form side and back support parts 27, 28.

The base 10, the seat surface 11 and the side and back support parts 27, 28 advantageously comprise parts of a shell structure formed integrally from a suitable plastics material. The seat surface 11 is suitably planar and substantially horizontal and may be provided with perforations 29, in the manner illustrated. The bottom edges of the base 10 lie on a horizontal plane common to all said edges, and are provided with feet 30 made, for example, of rubber or plastics, to prevent the infant's chair from sliding against a supporting surface.

The base 10 is provided at 31 with slots through which straps 32, 33 are passed, as indicated in FIG. 3. The reference 34 designates strap fasteners which secure a respective end of said straps within the interior of the infant's chair, whereas the reference 35 designates a locking device which is arranged to co-act with the securely lock the outer end (not shown) of the strap 32, subsequent to placing the infant's chair on the seat of a conventional chair and passing the strap 32 underneath said seat.

The reference 36 designates generally a front and crutch support, comprising a cross-piece 38, which extends substantially parallel with the front edge 37 of the seat surface 11, and a crutch-piece 39 which extends downwardly from the center region of the cross-piece. As shown more clearly in FIG. 6, extending from the lower end of the crutch-piece 39 is a downwardly facing projection 40 which will fit into a hole in the seat surface 11, preferably one of the preforations 29, and which is received in said hole when the front and crutch support 36 is mounted in position, as illustrated in FIG. 1 for example.

As will be seen clearly from FIGS. 1 and 5, at least a major part of the length of the upper edges 24 of the side support parts 27, from the front of the chair rearwardly, lies at a level considerably below the level of the upper edge of the cross-piece 38. For example, the side support parts 27 may be substantially horizontal and extend above the seat surface 11 to a height equalling about 0.2–0.75 times, preferably about 0.5–0.75 times the height of the upper edge of the cross-piece 38 above the seat surface. In order to provide adequate lateral support for such small children as those who need to be supported against toppling, the side support parts 27 are extended upwardly to a level with the upper edge of the cross-piece 38, with the aid of extension pieces 41 which are formed integrally with the cross-piece 38 and extend rearwardly from the ends thereof.

As will be seen more clearly from FIG. 3, each extension piece 41 is of U-shaped cross-section and has substantially straight depending legs 42 and a gently rounded web which forms the upper side 43 of the extension piece 41. In order to stiffen the extension pieces 41, they are provided internally with transverse stiffening webs 44. In the illustrated embodiment, the front and crutch support 36 is secured with the aid of screws 45 which pass from inside the infant's chair through holes 46 (FIG. 4) provided in the upper edges 24 of the side support parts 27, and are screwed into sleeves 47. The arrangement is such that the lower edges of the legs 42 engage respective walls 18, 21 and 20, 23 with no clearance therebetween, and extend upwardly as continuations of said walls.

In order to enable children who no longer need the protection afforded by a front and crutch support, or lateral support to prevent them falling sideways, to sit comfortably in the chair, the front and crutch support 36, and the extension pieces 41 associated therewith, can be detached, as illustrated in FIG. 4, by removing the screws 45 passing through the holes 46 and engaging the sleeves 47. This provides a chair which is extremely comfortable for children of from 2 to 5 years of age, and affords plenty of room for freedom of movement. The substantially horizontal parts of the edges 24 suitably have a length corresponding to about 70–80% of the seating depth of the chair.

It may be desirable, in many cases, to be able to secure the chair, with the front and crutch support 36 fitted, to the leaf of a dining table for example. An arrangement suitable for this purpose is shown in FIG. 7, in which there is shown a part of the chair incorporating a junction between the cross-piece 38 and an extension piece 41, together with part of the leaf of a dining table. As illustrated in FIG. 7, a securing device may comprise a screw clamp 50 cast partly into rubber 49 or like material, wherewith a strap 51 formed integrally with the rubber element 49 and having therein a slit 52 can be placed around the cross-piece 38 and fitted over the screw part 53 of the clamp 50. It is preferred that two securing arrangements of the kind illustrated in FIG. 7 are used simultaneously, one at each junction between cross-piece 38 and extension piece 41. Alternatively there can be used a single, centrally positioned securing arrangement having two straps corresponding to strap 51, which are placed around the cross-piece 38 on both sides of the crutch-piece 39, before being fitted over the screw part of the clamp.

As shown in FIGS. 1, 2 and 4, the seat surface 11 may be provided with slots 54 for accommodating a safety harness shown at 55 in FIG. 3.

The infant's chair according to the invention may advantageously have a seat height of about 100 mm. When the side and crutch support 36 is fitted, the height of the front support and the side support, including the height of the extension pieces 41, may reach about 140–180 mm. The height of the back support should be at least about 160 mm, and at least equal to the height of the side support.

The invention is not restricted to the described and illustrated embodiment, but can be achieved in any suitable manner within the scope of the inventive concept as defined in the claims.

I claim:

1. An infant's chair adapted to be placed on the seat of a conventional chair, said infant's chair comprising:

a base of substantially square horizontal cross-section and defining an upper seat surface at a top of said base;

two side support parts and a back support part formed integrally with said base and said upper seat surface and extending upwardly from a respective one of three base sides and three edges of said upper seat surface, upper edges of said two side support parts having a gently rounded cross-section;

means for securing the infant's chair to the seat of a chair; and a front and crutch support detachably mounted on said base, said front and crutch support including a cross-piece extending substantially parallel with a front edge of said upper seat surface, and further including an upstanding crutch-piece extending between central regions of said cross-piece and said front edge, said upper edges of said two side support parts extend substantially horizontally from the front of the infant's chair over at least a major part of their length at a height above said upper seat surface corresponding to about 0.2 to 0.75 times a height of an upper edge of said cross-piece mounted above said upper seat surface, and said two side support parts extend upwardly to a height corresponding approximately to a level of said upper edge of the cross-piece with the aid of extension pieces formed integrally with said cross-piece and extending rearwardly from the ends of said cross-piece.

2. An infant's chair according to claim 1, wherein said height of said upper edges of said two said support parts above said upper seat surface correspond to about 0.5 to 0.75 times said height of said upper edge of said cross-piece mounted above said upper seat surface.

3. An infant's chair according to claim 1, wherein said upper seat surface is substantially planar.

4. An infant's chair according to claim 1, wherein said base is provided at said two side support parts with through-passing slits, adapted to receive strap means for securing the infant's chair to the seat of a chair.

5. An infant's chair according to claim 1, wherein said upper seat surface is provided with perforations.

6. An infant's chair according to claim 1, wherein said upstanding crutch-piece includes at a lower end a downwardly extending projection which is received in a hole defined in said upper seat surface.

7. An infant's chair adapted to be placed on the seat of a chair, said infant's chair comprising:

a base of substantially square horizontal cross-section and defining an upper seat surface at a top of said base;

two side support parts and a back support part formed integrally with said base and said upper seat surface and extending upwardly from a respective one of three base sides and three edges of said upper seat surface, upper edges of said two side support parts having a gently rounded cross-section;

means for securing the infant's chair to the seat of a chair; and a front and crutch support detachably mounted on said base, said front and crutch support including a cross-piece extending substantially parallel with a front edge of said upper seat surface, and further including an upstanding crutch-piece extending between central regions of said cross-piece and said front edge, said upper edges of said two side support parts extending substantially horizontally from the front of the infant's chair over at least a major part of their length at a height above said upper seat surface corresponding to about 0.2 to 0.75 times a height of an upper edge of said cross-piece mounted above said upper seat surface, and said two side support parts extend upwardly to a height corresponding approximately to a level of said upper edge of the cross-piece with the aid of extension pieces formed integrally with said cross-piece and extending rearwardly from the ends of said cross-piece;

said extension pieces having a substantially U-shaped vertical cross-section and a gently rounded upper side and depending legs, bottom edges of said extension pieces being arranged to adjoin respective inner and outer surfaces of said two side support parts at a lowermost region of said upper edges and said upper edges having a gently rounded cross-section.

8. An infant's chair according to claim 7, wherein said two side support parts are of substantially U-shaped vertical cross-section and the legs of each of said extension pieces are arranged to extend in the form of a continuation of a respective inner and outer wall of an associated side support part.

9. An infant's chair according to claim 8, wherein said extension pieces are provided with internal transverse stiffening webs.

10. An infant's chair according to claim 9, wherein each of said extension pieces is provided with at least one internal sleeve means arranged to receive a fastening element for securing said extension pieces to an associated one of said two side support parts.

11. An infant's chair according to claim 10, wherein said fastening element comprises a screw passing through said upper edge of said associated one of said two side support parts from an inside of said part.

* * * * *